US010498074B2

(12) United States Patent
Gibboney, Jr.

(10) Patent No.: US 10,498,074 B2
(45) Date of Patent: Dec. 3, 2019

(54) ELECTRO-MECHANICAL COUPLER FOR ARTIFICIAL TREE SECTIONS

(71) Applicant: Boston Warehouse, Norwood, MA (US)

(72) Inventor: James W. Gibboney, Jr., Suches, GA (US)

(73) Assignee: Boston Warehouse, Norwood, MA (US)

( * ) Notice: Subject to any disclaimer, the term of this patent is extended or adjusted under 35 U.S.C. 154(b) by 0 days.

(21) Appl. No.: 16/043,984

(22) Filed: Jul. 24, 2018

(65) Prior Publication Data

US 2019/0089094 A1 Mar. 21, 2019

Related U.S. Application Data

(60) Provisional application No. 62/559,769, filed on Sep. 18, 2017.

(51) Int. Cl.
*H01R 13/627* (2006.01)
*H01R 13/703* (2006.01)
*A47G 33/06* (2006.01)

(52) U.S. Cl.
CPC ..... *H01R 13/6271* (2013.01); *A47G 33/06* (2013.01); *H01R 13/703* (2013.01)

(58) Field of Classification Search
CPC ..... H01R 13/193; H01R 13/62938; H01R 13/6275; H01R 13/6272; H01R 23/7073
USPC ..... 439/157, 342, 350, 352, 357, 660
See application file for complete search history.

(56) References Cited

U.S. PATENT DOCUMENTS 3,599,167 A * 8/1971 Adrian ..... H01R 13/633 200/51.09
4,840,574 A * 6/1989 Mills ..... B23K 9/323 439/157
5,275,575 A * 1/1994 Cahaly ..... H01R 13/7032 200/51.1
5,368,496 A * 11/1994 Ranalletta ..... A61N 7/00 439/261
5,411,402 A * 5/1995 Bethurum ..... G06K 19/07743 29/857

(Continued)

FOREIGN PATENT DOCUMENTS

CN 205122893 3/2016
CN 106654708 A 5/2017

*Primary Examiner* — Thanh Tam T Le
(74) *Attorney, Agent, or Firm* — Nexsen Pruet, LLC; Michael A. Mann

(57) ABSTRACT

An electro-mechanical coupler includes a source housing with a source surface and a load housing with a load surface. Both housings have through-holes for inserting and attaching tubes. One end of a first tube is insertable into the other tube. The source and load housings carry sets of plural electrical terminals that are brought into electrical contact with each other when the housing surfaces engage and they are oriented in a complementary topographic combination, such as the beveled slots of the source housing receiving the beveled inserts of the load housing. Spring-loaded plural electrical terminals extend from the bottom of the slot in the source housing and from the end of the insert in the load housing. A pivoting, sliding latch holds the source housing to the load housing, and a cam system assists in separating the source and load housings and their respective tubes.

17 Claims, 5 Drawing Sheets

(56) References Cited

U.S. PATENT DOCUMENTS

| | | | | | |
|---|---|---|---|---|---|
| 5,538,437 | A * | 7/1996 | Bates | H01R 13/6275 | 439/352 |
| 5,975,929 | A * | 11/1999 | Matsuura | H01R 13/62972 | 439/157 |
| 6,132,233 | A * | 10/2000 | Fukuda | H01R 13/6272 | 439/352 |
| 6,142,787 | A * | 11/2000 | Ikesugi | H01R 13/62933 | 439/15 |
| 6,419,507 | B2 * | 7/2002 | Kurimoto | H01R 13/62938 | 439/157 |
| 7,731,519 | B1 * | 6/2010 | Swenson, Jr. | H01R 13/6271 | 439/352 |
| 7,857,651 | B2 * | 12/2010 | Chen | H01R 13/5219 | 439/352 |
| 7,867,008 | B1 * | 1/2011 | Lin | H01R 13/6392 | 439/350 |
| 8,357,004 | B2 * | 1/2013 | Tao | H01R 13/64 | 439/352 |
| 8,591,247 | B2 * | 11/2013 | Zhu | H01R 13/6273 | 439/352 |
| 8,968,021 | B1 * | 3/2015 | Kennedy | H01R 13/6273 | 439/352 |
| 9,209,546 | B1 * | 12/2015 | Gibboney, Jr. | H01R 13/17 | |
| 9,252,539 | B2 * | 2/2016 | Condo | H01R 13/6456 | |
| 9,431,765 | B2 | 8/2016 | Tao | | |
| 9,700,169 | B2 | 7/2017 | Wong | | |
| 9,819,127 | B2 * | 11/2017 | Condo | H01R 13/6456 | |
| 2004/0145916 | A1 | 7/2004 | Wu | | |
| 2013/0301247 | A1 | 11/2013 | Chen | | |

* cited by examiner

ELECTRO-MECHANICAL COUPLER FOR ARTIFICIAL TREE SECTIONS

TECHNOLOGY FIELD

The present disclosure relates generally to electro-mechanical couplers that may be connected to hold two tubes together and to deliver electrical power through those tubes from a source of electrical power to a load. More specifically, the disclosure relates to electro-mechanical couplers for use in pre-lighted artificial holiday trees.

BACKGROUND

Artificial trees are gradually replacing traditional, live evergreen trees as a platform for holiday decorating inside homes. Artificial trees are more convenient and less expensive if used over several seasons, do not dry out leaving pine needles to clean up, require no watering, and are viewed by many as more environmentally friendly. Artificial trees are also becoming more realistic in appearance and may include lights strings already in place including an internal power source to light them.

Artificial trees, however, are not without drawbacks. One of those issues is how tree sections are joined. A friction-fit joint is commonly used, but such a joint may prove unsatisfactory. If the tree sections corrode, they become more difficult to join and separate. A friction-fit joint may also be loose and tend to come apart when an upper section is lifted without holding the lower section. When an assembled, decorated tree is moved, even if only a few inches, the tree sections may loosen and become difficult to control as they come apart. If a holiday tree is pre-wired, loss-of-control is compounded because the wires may remain connected among the now-separated sections and loose wires may arc. The tree sections should join and separate easily, safely and with sufficient but not undue effort.

A simpler, more reliable, safer electro-mechanical coupler for artificial holiday trees would be of advantage.

SUMMARY

According to its major aspects and briefly described, an electro-mechanical coupler includes a source housing having a source surface and a first through-hole. The source housing carries plural electrical terminals ending at its source surface. The electro-magnetic coupler also includes a load housing with a load surface and a second through-hole. The load housing somewhat mirrors the source housing in that it carries plural electrical terminals at its load surface. The load surface and said source surface have a complementary combination of higher regions and lower regions formed therein to enable the source housing and the load housing to engage in a single orientation. When in that single orientation, the electrical terminals of the load surface are then in electrical contact with the plural electrical terminals of the source surface, and the first through-hole is aligned with the second through-hole.

A first end of a first tube may be inserted into the source housing and fastened to the source housing. The second end of the first tube may be inserted into the load housing and fastened to the load housing. Two such tubes may be joined, the end of one tube being inserted into the end of the other tube to bring the source housing into engagement with the load housing, preferably by frictionally fitting the two tubes together.

An aspect of the disclosure is that the plural electrical terminals are in a lower region of the source surface, such as in a slot, whereas the complementary region of the load surface includes a higher region, which may be an insert. The slot and the insert may be curved. The sides of said curved insert and said curved slot are beveled so the insert slides easily into the slot of the other as the source housing is rotated with respect to the load housing.

Another aspect of the disclosure is that the complementary combination of the source surface and the load surface may include two higher regions formed therein as two inserts in the load surface and two lower regions formed therein as two slots in the source surface. One of the two insert and one of the two slots may be radially closer to the second through-hole than the other insert and slot.

Another aspect of the disclosure is a latch operable to hold the load housing and the source housing in engagement, when said latch is seated in the locked position.

Another aspect of the disclosure is that the load housing may have a channel formed in it to receive and hold the latch so the latch slides out of its seated, locked position and to its unlocked position. Also, the side of the source housing may have a latch slot formed in it, into which slot the end of the latch will seat when the latch has slid into the locked position.

Another aspect of the disclosure is that the latch has a spring that biases the latch to seat in the locked position and away from the unlocked position.

Another aspect of the disclosure is that the plural electrical terminals of the source housing are spring-loaded so they extend slightly above the source surface and tend to follow the terminals of the load surface in the event of a small-gap separation between the source housing and the load housing.

An aspect of the disclosure is that there may be plural source wires in the source housing and plural load wires in the load housing. The source tube is received in the first through-hole, and the load tube is received in the second through-hole.

Another aspect of the disclosure is a cam system to help separate the source coupler from the load coupler in the event the source tube and the load tube become stuck together. Rotation of the cam lever pries the load coupler off the source coupler, enabling the source tube and the load tube to separate.

These and other aspects of the electro-mechanical coupler will be apparent to those skilled in the art from a careful reading of the following Detailed Description, accompanied by the following drawings.

BRIEF DESCRIPTION OF THE DRAWINGS

In the figures.

DETAILED DESCRIPTION

An electro-mechanical coupler is disclosed herein for use with artificial trees such as artificial evergreen-type trees, as might be used for interior decorations during winter holidays. The present electro-mechanical coupler may be used to join tube sections representing the trunk of the artificial tree and to deliver electrical energy to lighting on the artificial tree limbs.

Figure 1:
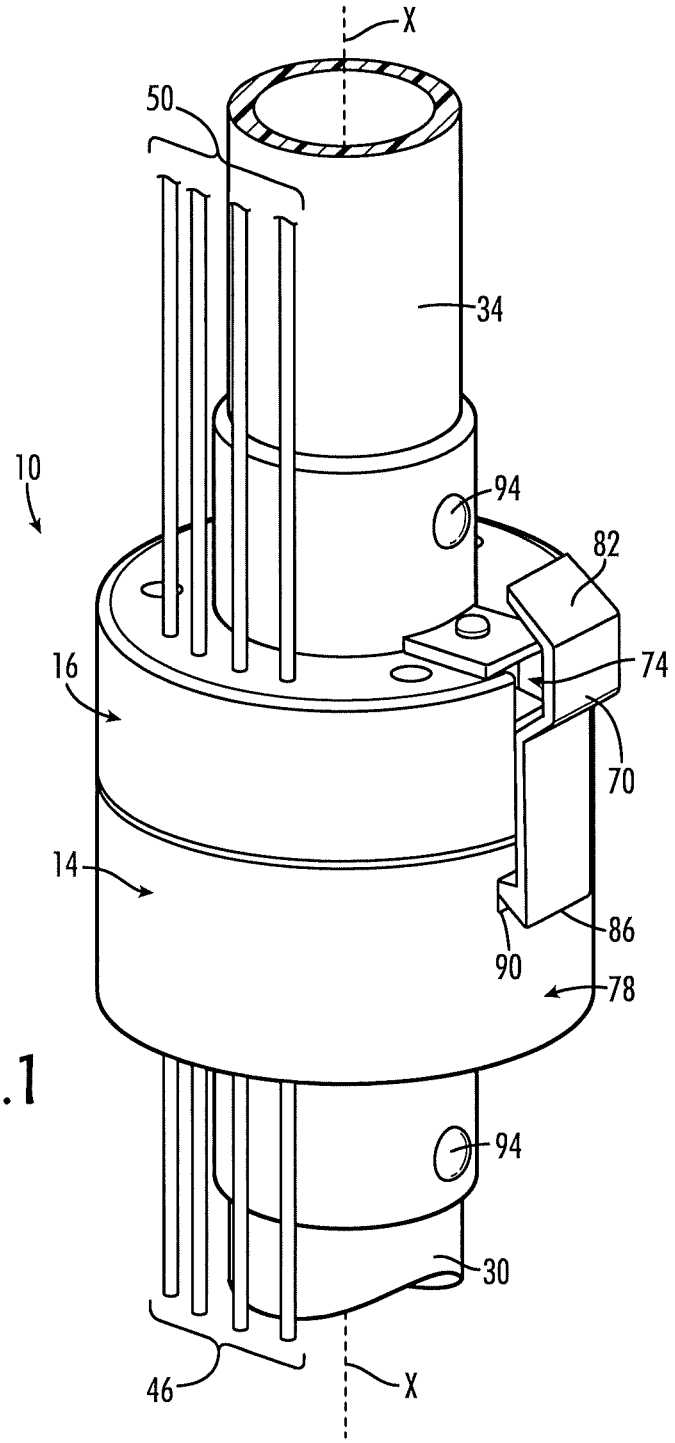
FIG. 1 is an upper perspective view of the present electromechanical coupler, according to an aspect of the disclosure.
Figure 2:
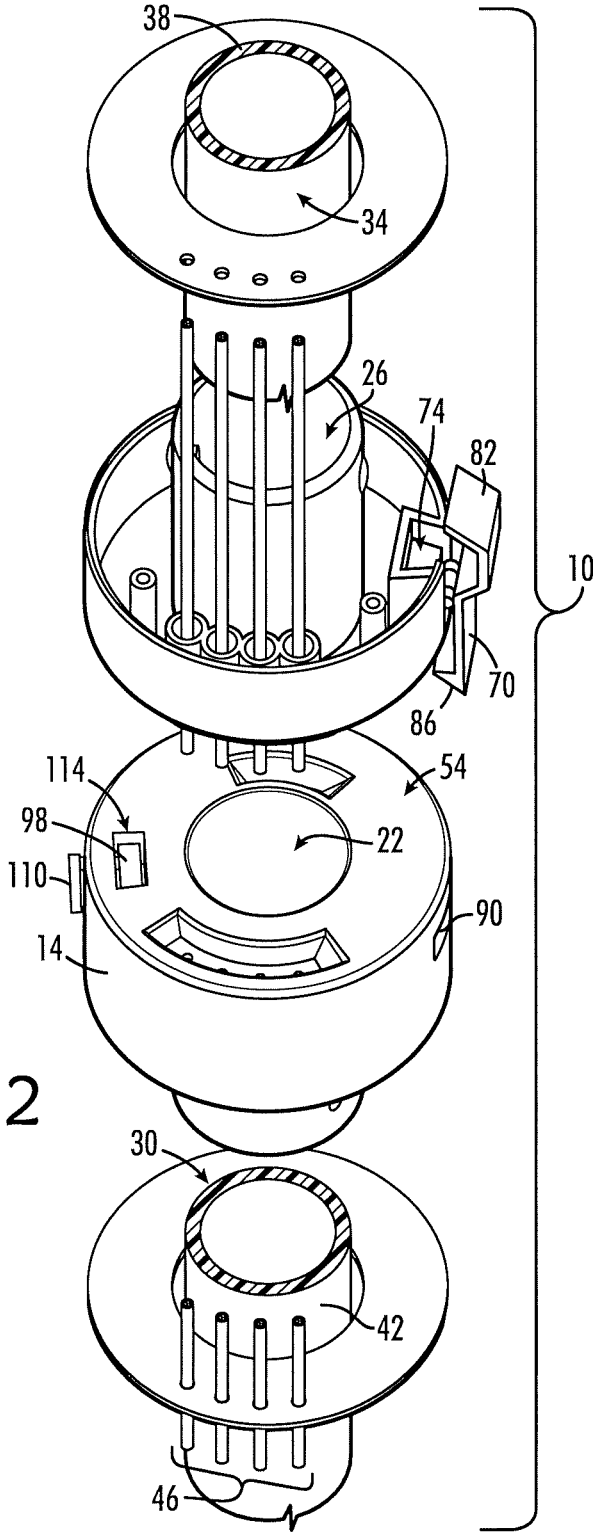
FIG. 2 is an upper, exploded, perspective view of the present electromechanical coupler, according to an aspect of the disclosure.
Figure 5:
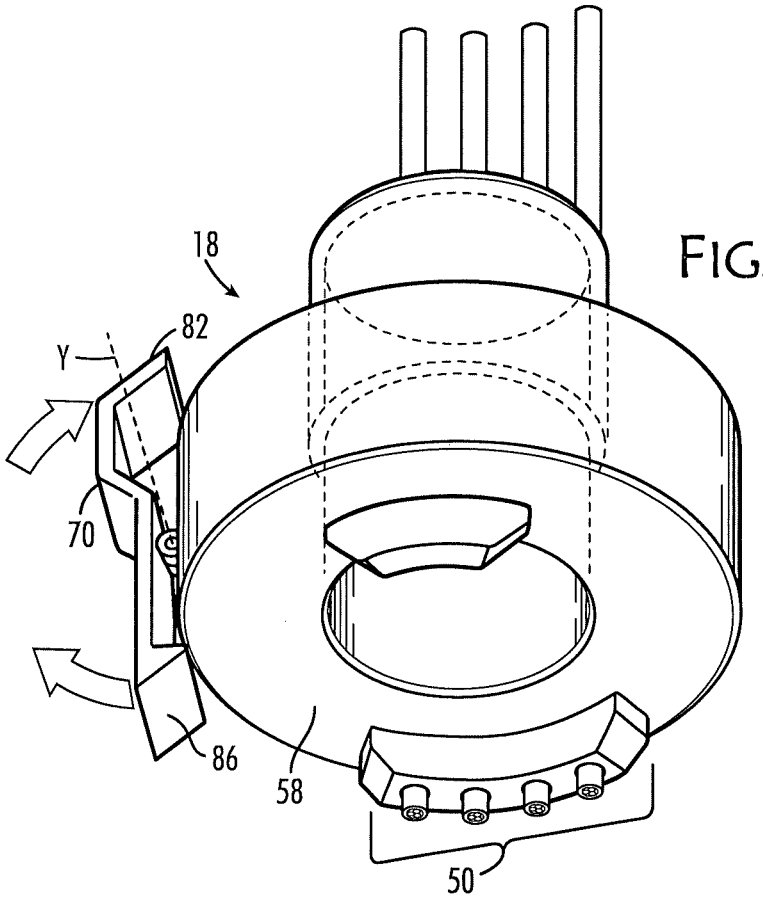
FIG. 5 is a bottom perspective view of the load housing showing the load housing surface and the latch, according to an aspect of the disclosure.

An electro-mechanical coupler, generally indicated by reference number 10 in FIGS. 1, 2, and 5, has two major components, namely a source housing 14 and a load housing 18. Source housing 14 will be closer to a source of electrical power and load housing 18 will be downstream of source housing 14 and therefore will become the electrical power load for the electrical power source provide by source housing 14. When used on an artificial holiday tree, the source housing 14 will be lower and therefore closer to the source of power than the load housing 18.

Both source housing 14 and load housing 18 have through-holes 22, 26, respectively, dimensioned to receive source tube 30 and load tube 34, respectively, representing two sections of an artificial tree trunk that are to be joined mechanically. Used as a section of an artificial tree trunk, source tube 30 may have load housing 18 on its lower or first end 38 and a source housing 14 on its upper or second end 42. In FIG. 2, the intersection of a source tube 30 and load tube 34 shows a source housing 14 on a second end 42 of source tube 30 and a load housing 18 on a first end 38 of load tube 34. Each of source housing 14 and load housing 18 carries a first set 46 of plural electrical terminals and a second set 50 of plural electrical terminals, respectively, for transferring the electrical power from source tube 30 to the load tube 34.

Source housing 14 has a source surface 54; first set 46 of plural electrical connector ends at source surface 54. Similarly, load housing 18 has a load surface 58; second set 50 of plural electrical terminals ends at said load surface 58. When source housing 14 and load housing 18 are engaged, as shown in FIG. 1, source surface 54 and load surface 58 are touching and first set 46 and second set 50 are in electrical connection.

Source surface 54 and load surface 58 are formed so as to comprise a complementary combination of higher regions and lower regions to enable source housing 14 and said load housing 18 to engage in a single relative orientation with respect to each other, that is, they are oriented so that source surface and load surface have a unique relationship to each other that allows them to fully engage. In that orientation, where source surface 54 and load surface combine complementarily, first set 46 of plural electrical terminals and second set 50 of plural electrical terminals are engaged, that is, in physical and in electrical contact with each other and through-hole 22 of source housing 14 is aligned with through-hole 26 of load housing 18.

The terms higher regions and lower regions are topographic in nature and refer to regions or places on source surface 54 and on load surface 58 that are either elevated or depressed with respect to other regions or places of those surfaces. The terms higher and lower, or elevated and depressed, apply when source housing 14 and load housing 18 are oriented so that source surface 54 and load surface 58 are horizontal and both source surface 54 and load surface 58 are on the respective tops of source housing 14 and load housing 18. When in use, load housing 18 is inverted with respect to source housing 14 and then load surface 58 is upside down and can be moved into engagement with source surface 54. An insert is an example of a higher region because it is elevated with respect to its immediate surroundings on the same surface; a slot is an example of a lower region because it is depressed with respect to its immediate surroundings on the same surface.

The term complementary combination refers to a set of higher and lower regions on one surface that engages a set of lower and higher regions, respectively, on the surface engaged, and wherein the heights and shapes of the higher regions match the depths and shapes of the lower regions. An insert is an example of a higher region that is complementary to a slot, which is an example of a lower region if the height and shape of the insert matches the depth and shape of the slot. Each of source surface 54 and load surface 58 may include both higher regions and lower regions or only higher or only lower regions, but the combination of source surface 54 and load surface 58 includes higher and lower regions. In addition, the higher and lower regions are selected so as to define a single rotational orientation of load surface 58 with respect to source surface 54 that results in engagement, meaning, each higher region of one is in a complementary lower region of the other.

An advantage may be obtained if source surface 54 has a first set 46 of plural electrical terminals in a lower region, and therefore load surface 58 has a second set 50 of plural electrical terminals in a complementary higher region. In this case, first set 46 of plural electrical terminals of source housing 14 are recessed below the balance of source surface 54, thus enabling the region of source surface 54 surrounding a lower region containing first set 46 of plural electrical terminals to shield accidental contact by another electrical terminal with first set 46 of plural electrical terminals.

As an example of such a lower region, source surface 54 may have one or more slots 62 formed in it and load surface 58 may have a corresponding one or more inserts 66 formed in it. The term slot refers to a depression in a surface; the term insert refers to a raised portion of a surface that can be inserted into a slot in an adjacent surface. An insert is insertable into a slot; a slot receives an insert. The shapes of slots 62 and inserts 66 do not have to be rectangular. Slots 62 and inserts 66 may be curved and may be beveled, that is, their sides are sloped at an angle other than 90 degrees with respect to the adjacent source surface 54 and load surface 58. Slots 62, if more than one of each on source surface 54, respectively, may each have different lengths or extents, that is, one slot of slots 62 may be shorter and a second slot of slots 62 may be longer. The terms shorter and longer refer to the lengths of slots 62 as measured along source surface 54 rather than perpendicular to source surface 54. Slots 62 may be offset, that is, located at a different radius from the axis of rotation of source housing 14 so that one slot of slots 62, for example, is closer to through-hole 22 than the other slot of slots 62. Slots 62 on source surface 54 may be diametrically opposed to each other and inserts 66 on load surface 58 may also be diametrically opposed to each other so that rotation of source housing 14 with respect to its axis of rotation causes plural inserts 66 to enter their corresponding slots 62 at the same time. As inserts 66 seat in slots 62, second set 50 of plural electrical terminals of said load surface move into electrical contact with first set 46 of plural electrical terminals of said source surface, and first through-hole 22 is aligned with second through-hole 26. The beveled edges of inserts 66 will rub against first set 46 of plural electrical terminals as load surface 58 comes to rest on source surface 54. This interaction and the resulting friction between them tends to prevent build-up of corrosion on first set 46 of plural electrical terminals in slots 62 and second set 50 of plural electrical terminals in inserts 66.

Figure 4A:
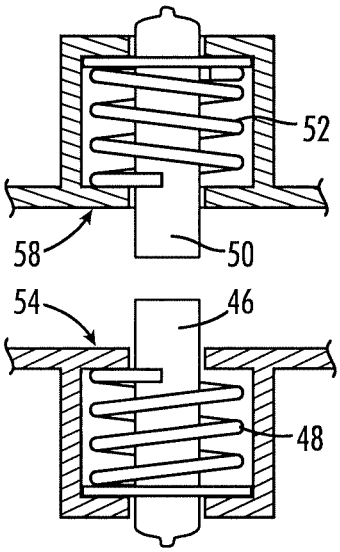
FIG. 4A is a side cross-sectional view of a detail of the source coupler and the load coupler showing the spring-biased plural electrical terminal of the source coupler slightly extended by its spring because the source housing is separated from the load housing.
Figure 4B:
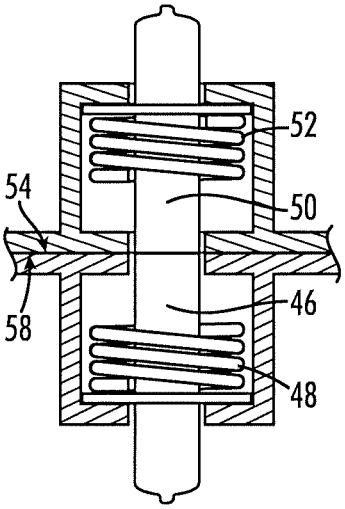
FIG. 4B is a cross-sectional view of a detail of the source coupler and the load coupler showing the plural electrical terminals of each pressed against each other, the electrical terminal of the source coupler retracted against the spring.

As illustrated in FIG. 4A, first set 46 of plural electrical terminals extends slightly beyond source surface 54 when those surfaces are separate. FIGS. 4A and 4B show one electrical terminal each of first set 46 and second set 50 of plural electrical terminals and plural electrical terminals in each of first set 46 and second set 50 are identical. Plural electrical terminals of first set 46 are pins that have generally flat ends but may be slightly rounded at their edges. Plural electrical terminals of second set 50 may have a broader and slightly rounded exposed surface.

As illustrated in FIG. 4B, when source surface 54 and load surface 58 are brought into engagement, first set 46 of plural electrical terminals is pushed flush with source surface. First set 46 of plural electrical terminals is pushed against the urging of compression spring 48, respectively, which extends until source surface 54 and load surface 58 are fully engaged.

In the event source housing 14 or load housing 18 moved with respect to each other, and source surface 54 and load surface 58 begin to separate, first set 46 and second set 50 of plural electrical terminals will tend to remain in contact as first set 46 of plural electrical terminals, urged by compression spring 48, extend above source surface 54 (compare FIGS. 4B to 4A). As separation of source surface 54 and load surface 58 continues, first set 46 and second set 50 of plural electrical terminals inevitably break their electrical connection. However, slight movement of source housing 14 with respect to load housing 18 will not cause arcing.

Four electrical terminals are shown in each of first set 46 and second 50. A different number of terminals may be used, and terminals may also be provided in the other slots 62 and inserts 66. Slots 62 and inserts 66 may be longer to accommodate additional terminals. Four terminals provide for three independent circuits and one common return line. Multiple independent circuits enables different lighting effects.

A latch 70 is carried by load housing and operable to hold load housing 18 and source housing 14 in engagement. Latch 70 is received in and seats in a channel 74 formed in load housing 18, which channel 74 may be narrower at lateral surface 78 of load housing 18 than it is more radially inward of lateral surface 78 so as to prevent latch 70 from being pulled laterally from load housing 18. Within channel 74, latch 70 is permitted to be moved axially with respect to load housing 18 and therefore slide between a locked position (deeper into channel 74) and an unlocked position (shallower in channel 74).

As best seen in FIG. 5 and indicated by arrows, latch 70 is pivotally attached to load housing 18 so that latch 70 may be pivoted about axis Y. Top 82 of latch 70 is held to load housing via channel 74; bottom 86 of latch 70 seats into a latch slot 90 (best seen in FIGS. 1 and 2) to hold load housing 18 to source housing 14. Pivoting top 82 of latch about pivot axis Y removes bottom 86 of latch 80 from latch slot 90 whereupon, latch 70 may be slid axially upwards through channel 78 away from source housing 14 and toward load housing 18 to enable a user to separate load housing 18 from source housing 14.

Source housing 14 and load housing 18 are attached to source tube 30 and load tube 34, respectively using fasteners 94. Fasteners 94 may be bolts, screws, pins, rivets, self-taping screws or nylon expansion fasteners. Holes are formed in source housing 14 and load housing 18. Then source tube 30 is aligned with source housing 14 and load tube 34 is aligned with load housing 18. Nylon expansion fasteners, for example, may be used as fasteners 94 and are inserted into the aligned holes, their nylon lock pins (not shown) are inserted into holes in the ends of expansion fasteners. As the lock pins are forced in, they spread out the flanges of expansion fasteners on the inside of source tube 30 and load tube 34, which pulls the expansion fasteners tight. The advantage of this method is the lock pins and expansion fasteners can be removed if broken or worn out.

Source tube 30 is joined to load tube 34 by inserting one into the other so that there is an overlap, which may be 7 or 8 cm in length (about 3 inches). This overlap provides good support for both tubes. The extent of insertion of one into the other may be limited by any convenient means, such as by dimples formed in one or both source tube 30 and load tube 34.

When source tube 30 and load tube 34 are to be separated, one can be simply pulled from the other. In the event they are stuck together, such as may result from corrosion of source tube 30 and load tube 34, a cam system is provided to assist in separation.

Figure 3A:
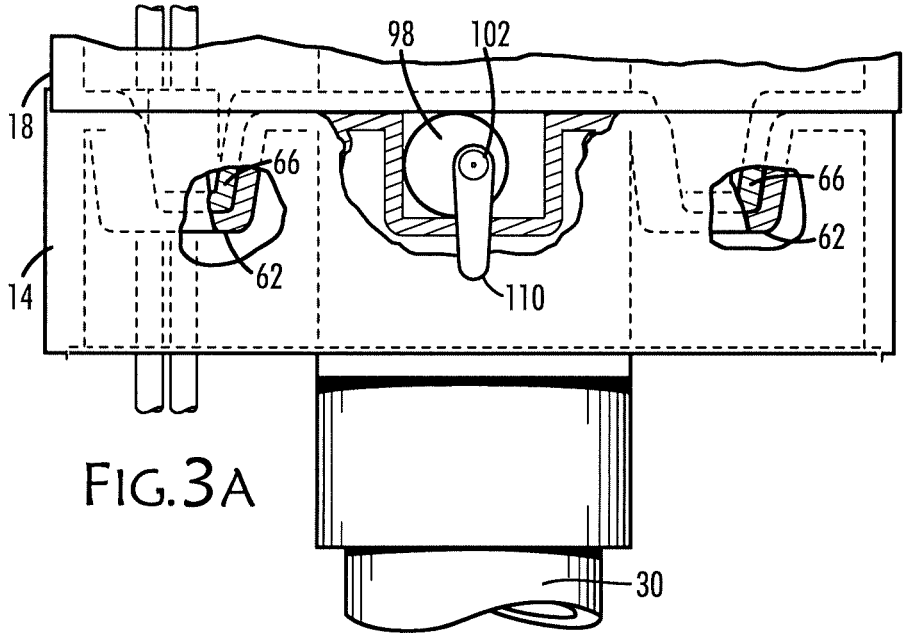
FIG. 3A is a side view of the present electromechanical coupler showing the cam latch seated in a latched position, according to an aspect of the disclosure.
Figure 3B:
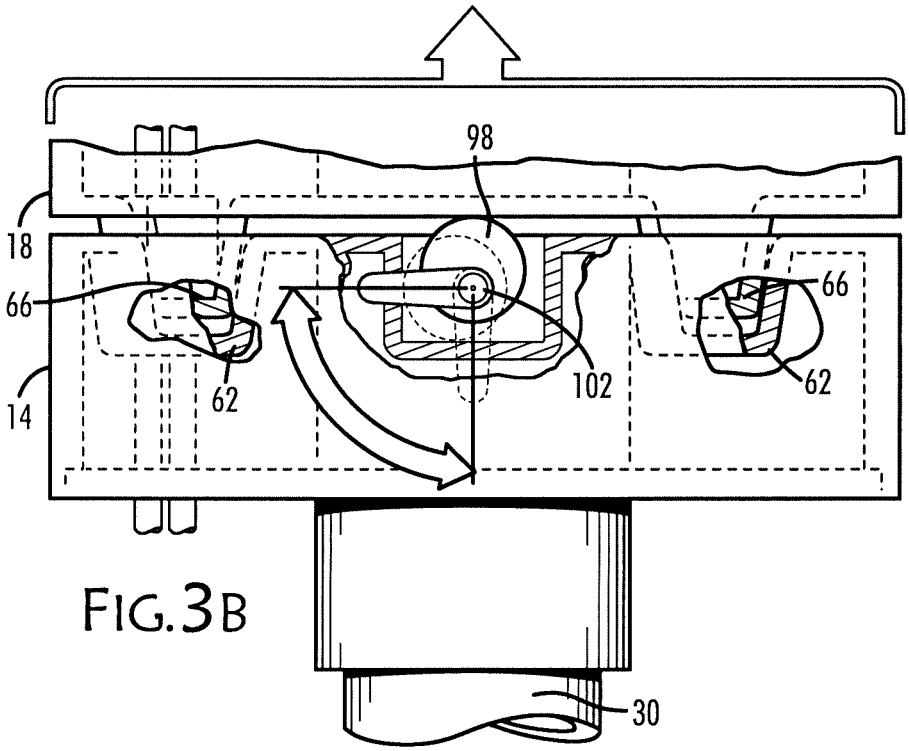
FIG. 3B is a side view of the present electromechanical coupler, with the cam latch rotated out of the, seated, latched position to the lifted position, according to an aspect of the disclosure.

Cam system, best seen in FIGS. 3A and 3B, but also seen in FIG. 2, includes a cam 98 mounted off center on a shaft 102 that passes through a hole formed in source housing 14. A lever 110 on the end of shaft 102 enables a user to rotate shaft 102 and cam 98 on the opposing end of shaft 102. Cam 98, being mounted off-center, will extend through a slot 114 on source surface 54. When load surface 58 is engaging source surface 54, the pressure of the rotating cam 98 pushing against it from below is sufficient to separate source surface 54 and load surface 58. Because source surface 54 and load surface 58 are attached to source tube 30 and load tube 34, respectively, load tube 34 will be moved from source tube 30 as cam 98 presses against load housing 18. That slight lift plus twisting of load housing 18 with respect to source housing 14 is sufficient to break load tube 34 free of source tube 30 and permit their separation. Beveled sides of slots 62 and inserts 66 facilitate the lift when source housing 14 and load housing 18 are twisted with respect to each other. Load housing 18 then rides out of slots 62 much more easily because of the beveling.

Those skilled in the art of artificial tree design will appreciate these and many other features and their advantages from the foregoing description of the present electro-mechanical coupler.

What is claimed is:

1. An electro-mechanical coupler, comprising:

(a) a source housing having a source surface and with a first through-hole formed therethrough, said source housing carrying plural electrical terminals at said source surface;

(b) a load housing having a load surface and a second through-hole, said load housing carrying plural electrical terminals at said load surface, wherein, said load surface and said source surface are formed to have a complementary combination of higher regions and lower regions; wherein said complementary combination includes two higher regions formed as inserts and two lower regions in the form of slots so as to enable said source housing and said load housing to engage in a single relative orientation wherein, when engaged, said plural electrical terminals of said load surface are in electrical contact with said plural electrical terminals of said source surface and said first through-hole is aligned with said second through-hole;

(c) a latch carried by said electro-mechanical coupler, said source housing having a latch slot formed therein, said latch being slidable between said locked position and said unlocked position, said locked position operable to hold said source housing and said load housing together when said latch is moved from said unlocked position to seat in said latch slot; and (d) a cam carried by said electro-mechanical coupler and operated by a lever to separate said source housing and said load housing.

2. The electro-mechanical coupler of claim 1, wherein said inserts are two curved inserts in said load surface and said slots are two curved slots in said source surface.

3. The electro-mechanical coupler of claim 1, wherein a first insert of said inserts is shorter than a second insert of said inserts.

4. The electro-mechanical coupler of claim 1, wherein a first insert of said inserts is radially closer to said second through-hole than a second insert of said inserts, and wherein said first insert, said second insert, said first slot and said second slot are curved.

5. The electro-mechanical coupler of claim 1, wherein a first insert of said inserts is radially closer to said second through-hole than a second insert of said inserts, and wherein said first insert, said second insert, said first slot and said second slot are curved.

6. The electro-mechanical coupler of claim 1, wherein a first insert of said inserts is radially closer to said second through-hole than a second insert of said inserts, wherein said inserts and said slots are beveled.

7. The electro-mechanical coupler of claim 1, wherein said latch is carried by said source housing.

8. The electro-mechanical coupler of claim 1, wherein said load housing has a channel formed therein, and wherein said latch is received in said channel when slid to said locked position to secure said load housing to said source housing.

9. The electro-mechanical coupler of claim 1, wherein said latch is biased to said locked position.

10. The electro-mechanical coupler of claim 1, wherein said plural electrical terminals of said load housing are spring-loaded to extend from said load surface.

11. The electro-mechanical coupler of claim 1, wherein said cam is carried by said source housing, and wherein said source housing has an opening formed in said source surface through which said cam rotates.

12. The electro-mechanical coupler of claim 1, further comprising a source tube in said first through-hole and a load tube in said second through-hole.

13. An electro-mechanical coupler, comprising:

(a) a source housing having a source surface and a first through-hole, said source housing carrying plural electrical terminals at said source surface;

(b) a load housing having a load surface and a second through-hole, said load housing carrying plural electrical terminals at said load surface;

(c) a source tube having a first end and a second end, said second end of said source tube being in said first through-hole of said source housing;

(d) a load tube having a first end and a second end, said first end of said load tube being in said second through-hole of said load housing;

(e) plural electrical conductors running from said plural electrical terminals of said source housing to said plural electrical terminals of said load housing; and (f) a cam carried by said electro-mechanical coupler and operated by a rotatable lever to separate said source housing and said load housing;

wherein said load surface and said source surface are formed so as to have a complementary combination of higher and lower regions so as to enable engagement of said source housing and said load housing in a single orientation wherein said plural electrical terminals of said load housing are in electrical contact with said plural electrical terminals of said source housing at said complementary combinations.

14. The electro-mechanical coupler of claim 13, further comprising a sliding latch carried by said load housing having a locked position and an unlocked position.

15. The electro-mechanical coupler of claim 14, wherein said load housing has a channel formed therein to receive said sliding latch.

16. The electro-mechanical coupler of claim 14, wherein said source housing is formed so as to have a slot therein.

17. The electro-mechanical coupler of claim 14, wherein said sliding latch is spring biased to hold said source housing in engagement with said load housing.

* * * * *